US006837677B2

(12) United States Patent
Zhang et al.

(10) Patent No.: US 6,837,677 B2
(45) Date of Patent: Jan. 4, 2005

(54) IMPELLER SEALING ARRANGEMENT

(75) Inventors: David Da-Wei Zhang, Doncaster (AU); Hugh Barr McDonald, Boronia (AU)

(73) Assignee: Davey Products Pty Ltd, Victoria (AU)

( * ) Notice: Subject to any disclaimer, the term of this patent is extended or adjusted under 35 U.S.C. 154(b) by 76 days.

(21) Appl. No.: 10/275,166

(22) PCT Filed: May 1, 2001

(86) PCT No.: PCT/AU01/00490

§ 371 (c)(1),
(2), (4) Date: Jan. 9, 2003

(87) PCT Pub. No.: WO01/83995

PCT Pub. Date: Nov. 8, 2001

(65) Prior Publication Data

US 2004/0028524 A1 Feb. 12, 2004

(30) Foreign Application Priority Data

May 1, 2000 (AU) ..... PQ7213

(51) Int. Cl.[7] ..... F04D 29/08
(52) U.S. Cl. ..... 415/174.3; 416/174; 416/186 R
(58) Field of Search ..... 415/172.1, 174.3, 415/170.1; 416/186 R, 214 R, 174; 277/422

(56) References Cited

U.S. PATENT DOCUMENTS

| | | | | |
|---|---|---|---|---|
| 2,145,597 A | * | 1/1939 | Hait | 415/131 |
| 2,775,945 A | * | 1/1957 | Arutunoff | 415/172.1 |
| 4,083,647 A | * | 4/1978 | Tatkov et al. | 415/113 |
| 4,236,867 A | * | 12/1980 | Morris | 415/26 |
| 5,518,256 A | * | 5/1996 | Gaffal | 277/414 |
| 5,921,748 A | | 7/1999 | Frater | 415/172.1 |

FOREIGN PATENT DOCUMENTS

| | | |
|---|---|---|
| EP | 0039435 | 11/1981 |
| EP | 0554803 | 8/1993 |
| GB | 867586 | 5/1962 |
| GB | 2150221 | 6/1985 |
| JP | 11257287 | 9/1999 |

* cited by examiner

*Primary Examiner*—Ninh H. Nguyen
(74) *Attorney, Agent, or Firm*—Baker Botts LLP

(57) ABSTRACT

A seal arrangement for an impeller assembly, the impeller assembly including an impeller housing (34) adapted to receive a drive shaft. An impeller (10) is located within the impeller housing (34) and is adapted for connection to the drive shaft for rotation by the drive shaft about an axis. The seal arrangement includes an annular seal (24) located axially between the impeller housing (34) and the impeller (10) to provide a substantially fluid tight seal between the impeller housing (34) and the impeller (10).

9 Claims, 3 Drawing Sheets

IMPELLER SEALING ARRANGEMENT

FIELD OF THE INVENTION

This invention relates to housings for impeller assemblies that are commonly used in pumps for liquids. In particular, this invention relates to an improved sealing arrangement for use in an impeller assembly.

BACKGROUND OF THE INVENTION

Impeller assemblies typically include an impeller housing which is mounted on or operably connected with a central drive shaft. Attached to the shaft, within the housing, is an impeller. The impeller typically includes upper and lower cover plates and a vane plate located between the respective cover plates. Fluid to be pumped is introduced into the impeller housing at one side thereof. The shaft rotates so as to rotate the impeller assembly thereby creating regions of high and low fluid pressure within the impeller housing and pumping fluid passing through the impeller assembly.

Depending on the application of the pump, a pump can be a single-stage model i.e. having one impeller assembly, or a multi-stage model i.e. having a number of impellers in series on the same shaft passing through each of the impeller housings.

In order to maintain the desired pressure levels within the impeller assembly, the fluid flow path through each of the impeller assemblies within the pump must be sealed. One conventional means of sealing the impeller housing against the drive shaft is to provide a caged annular seal, located radially between the impeller housing and the drive shaft. The seal ring is contained within a radial cavity and is provided with room to float radially to compensate for radial movement of the impeller relative to the impeller housing.

This type of seal has proven to be effective but suffers a number of disadvantages. Firstly, the floating seal is not free to float axially, meaning that any axial movement of the impeller relative to the impeller housing cannot be compensated for. Secondly, the seal is located within a groove formed in the impeller housing. Installation, as well as removal and replacement of the seal, is an intricate operation given the "hidden" location of the seal. Further, in order to provide an adequate seal, the sealing ring and drive shaft must be manufactured with very small tolerances in internal diameter so that it closely receives the drive shaft of the impeller assembly.

The above disadvantages are of course amplified when the pump is a multi-stage model.

It is therefore an object of the invention to provide a sealing arrangement for an impeller assembly that at least in part alleviates one or more of the above disadvantages.

SUMMARY OF THE INVENTION

The invention accordingly provides a seal arrangement for an impeller assembly, the impeller assembly including:

an impeller housing adapted to receive a drive shaft; and an impeller located within the impeller housing and adapted for connection to the drive shaft for rotation by the drive shaft about an axis;

wherein the seal arrangement includes an annular seal located axially between the impeller housing and the impeller to provide a substantially fluid tight seal between the impeller housing and the impeller.

Advantageously, the annular seal includes two opposed substantially flat faces and a circumferential edge face.

When the impeller assembly is assembled, one flat face of the seal contacts an int rior face of the impeller housing. The opposite flat face of the seal faces a first surface of the impeller.

The impeller is preferably made up of lower and upper cover plates, which are operably connected to form the impeller. Advantageously, vanes defining fluid flow paths are located intermediate the upper and lower cover plates and may be formed integrally with the lower cover plate. The lower cover plate preferably includes an integral central upstanding boss through which the drive shaft passes. More preferably, the boss is keyed onto the drive shaft.

Advantageously, the outer surface of the upper cover plate of the impeller includes a raised annular lip. Alternatively, the raised lip may be provided on the surface of the seal facing the impeller.

The annular seal is placed over the central boss such that one flat face of the seal sits against the raised lip of the impeller. Alternatively, when the seal includes the raised annular lip, the raised annular lip sits against the upper cover plate. The annular lip serves to provide a small gap between the surface of the impeller and the seal such that, in use of the impeller, fluid under pressure enters into the gap. The action of the low fluid pressure in the impeller eye and the high fluid pressure in the gap between the seal and the impeller serves to force the seal away from the impeller and against the interior face of the impeller housing, thereby substantially sealing the impeller assembly.

The annular seal is preferably a floating seal moveable in the axial direction to compensate for axial displacement of the impeller relative to the impeller housing, allowing the assembly to be more tolerant of production variability.

BRIEF DESCRIPTION OF THE DRAWINGS

The invention will now be described by way of example, with reference to the accompanying drawings, in which.

DESCRIPTION OF THE PREFERRED EMBODIMENTS

Figure 1:
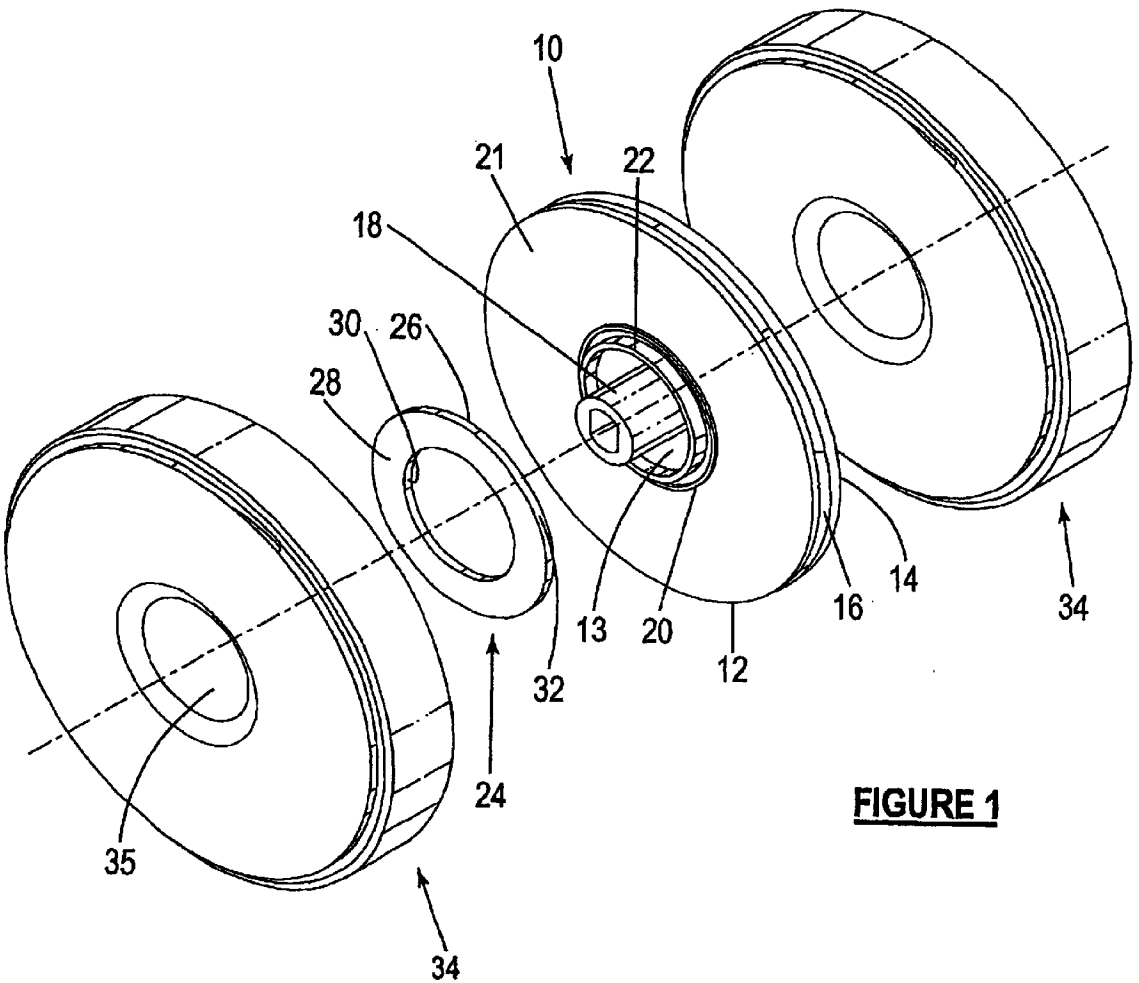
FIG. 1 is an isometric exploded view of an impeller assembly according to an embodiment of the invention.
Figure 2:
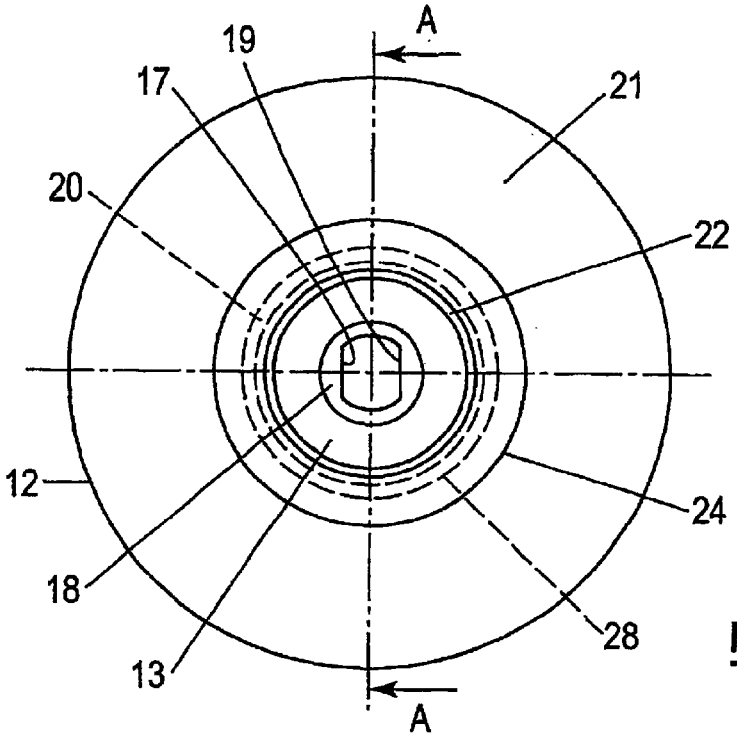
FIG. 2 is a plan view of the face of the impeller with the floating neck ring fitted.
Figure 3:
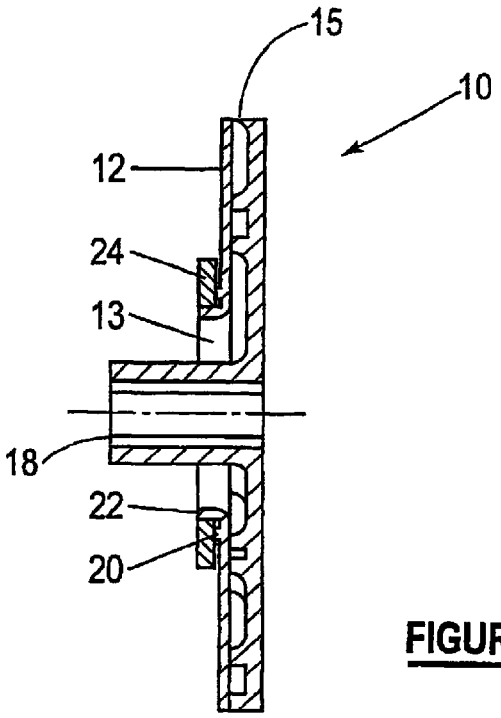
FIG. 3 is a side cross-sectional view of the impeller assembly of FIG. 1 when assembled, taken along the line A—A.

Referring to the drawings, FIG. 1 illustrates the primary components of a typical impeller assembly. The impeller assembly illustrated includes an impeller 10 having upper and lower cover plates 12, 14. Lower cover plate 14 includes integral vanes 16 formed on the interior face of the lower cover plate such that they are intermediate the lower and upper cover plates. Vanes 16 may be constructed in any conventional manner, and may be formed as a separate intermediate vane plate. The vanes 16 extend between the upper and lower plates so as to form passageways for fluid from the centre of the impeller to the outer edge of the impeller. The vanes 16 are typically involute and serve to create regions of high and low pressure within the impeller assembly, as it is rotated at high speed, so as to pump fluid through the impeller assembly.

The three plates of the impeller assembly may connected in any conventional manner. The plates may be fastened e.g.

by welding at the vanes or by gluing. There are many variations of the design of an impeller and the present invention is directed to use with an impeller having at least one cover plate, such as cover plate 12 having a substantially planar outer surface 21.

The impeller 10 is received within impeller housing 34. Housing 34 includes central aperture 35 through which a rotatable drive shaft (not shown) passes. Housing 34' illustrated in FIG. 1 serves to house the next impeller assembly in series in multi-stage model pumps.

Impeller 10 includes a central boss 18 which is integrally formed with lower cover plate 14. The boss 18 is keyed to the rotatable drive shaft. For this purpose, the inside surface of boss 18 includes a pair of opposed flats 17,19 which correspond to flats on the exterior surface of the drive shaft. The impeller 10 and housing 34 are secured onto the drive shaft using a nut or locking ring (not shown).

Upper cover plate 12 has a central aperture 13 through which the boss 18 and drive shaft extend. At the edge of the central aperture 13 is an annular flange 22. When the impeller is assembled, annular flange 22 is spaced radially from the boss 18 and extends coaxially therewith. The exterior circumference of flange 22 is sized to match the inside circumference of floating seal 24, as described below.

Spaced radially from the annular flange 22, and formed integrally with the upper cover plate 12, is a raised annular lip 20. Lip 20 may be formed separately and attached to the surface 21. As will be described below, the purpose of lip 20 is to raise the seal 24 from the surface 21 of the impeller 10, when the impeller 10 is assembled.

Seal 24 is a flat circular ring, having two opposed planar surfaces 26, 28 and interior and exterior edge faces 30, 32. The seal 24 may include one or more small through-holes (not shown) formed in the planar surfaces 26, 28 of the seal 24, in order to improve lubrication on the surface 28 of the seal. The seal 24 may additionally or alternatively also be formed with a radial slit or break (not shown) in the seal 24. Forming the seal with a radial slit or break enables the inner diameter of the seal 24 to adapt to the outer diameter of the boss 18.

When the impeller 10 is assembled, surface 26 of the seal 24 sits against raised lip 20, the lip 20 creating a small gap between the surface 21 of the impeller and the face 26 of the seal 24. The raised lip 20 is not as wide as the seal 24 leaving part of the surface 26 of the seal 24 raised from the face of the impeller 10.

The impeller 10 and seal 24 are located within impeller housing 34 such that face 28 of the seal 24 faces the interior face 33 of the impeller housing 34.

Figure 4:
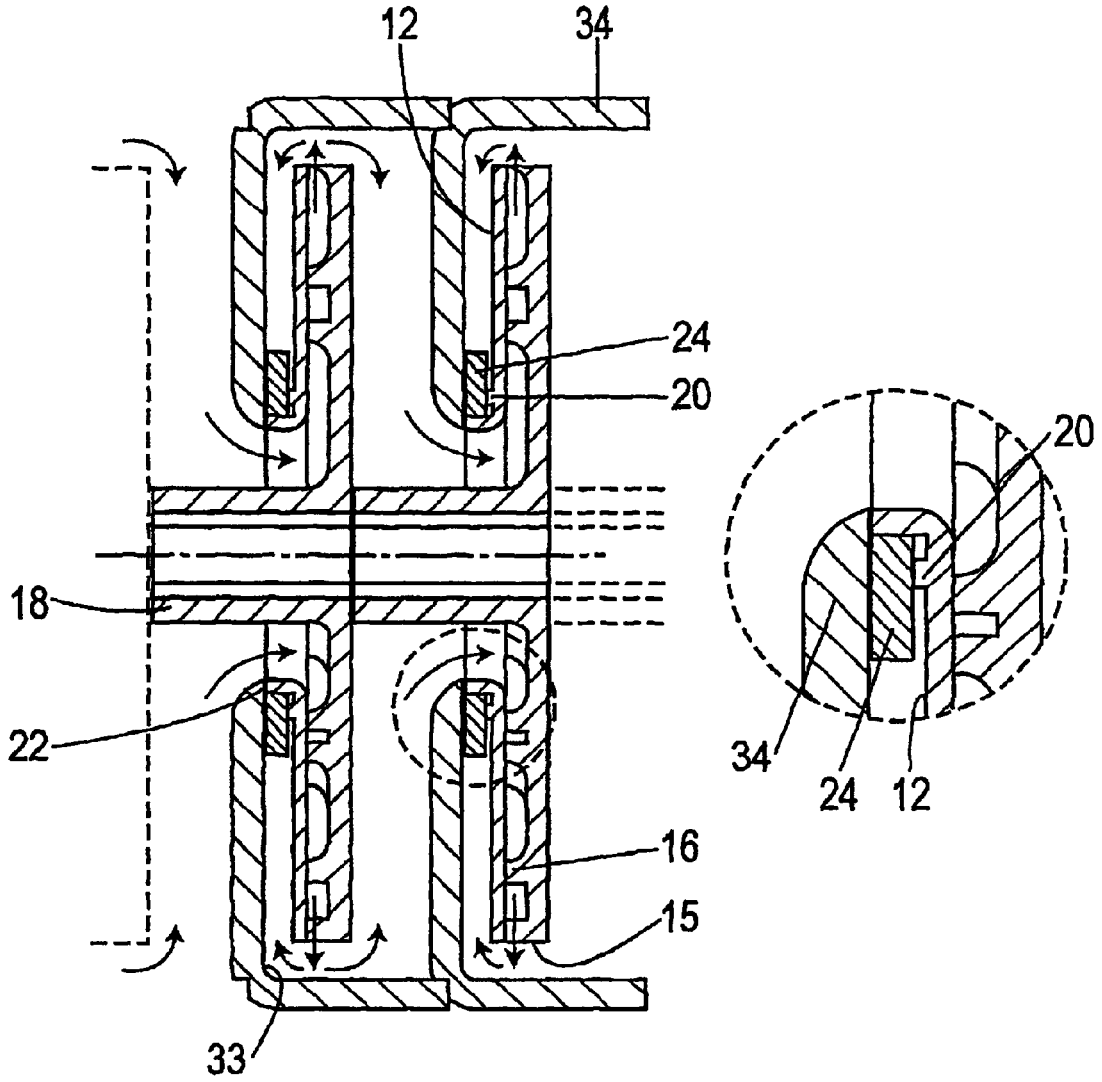
FIG. 4 is a side cross-sectional view of part of an assembled multi-stage model—2 impeller assemblies are illustrated.

Referring to FIG. 4, where arrows illustrate the direction of fluid flow in use, fluid is pumped through the impeller assembly from the centre of the impeller, via the vanes 16 to the edge 15 of the impeller 10. Fluid from the edge of the impeller can flow either in the direction of the next impeller housing 34 in series/the outlet of the pump or can flow behind the impeller 10 toward the seal 24. Fluid which flows in the direction of the seal 24 enters into the gap between the seal 24 and the impeller surface 21 thereby forcing the seal 24 against the interior 33 of the impeller housing 34. A substantially fluid tight seal is formed between the face 28 of seal 24 and the interior 33 of housing 34. Fluid flowing in this direction is therefore prevented from exiting the impeller housing 34 and is forced to exit the impeller housing via subsequent impeller housing or pump outlet. (not shown).

It will be appreciated that it is the action of the high pressure fluid acting against the seal 24 which forces the seal 24 against the interior 33 of the impeller housing and creates the seal.

The present invention therefore provides an effective fluid tight seal for an impeller assembly. The seal is free to float axially thereby compensating for axial movement of the impeller relative to the impeller housing. The seal is easy to position and, if necessary, can be removed and replaced by simply opening the impeller housing. Having an easily and readily accessible seal is particularly advantageous in multi-stage models which include a number of impeller assemblies.

It will be understood that the invention disclosed and defined herein extends to all alternative combinations of two or more of the individual features mentioned or evident from the text or drawings. All of these different combinations constitute various alternative aspects of the invention.

What is claimed is:

1. A seal arrangement for an impeller assembly, the impeller assembly including:

an impeller housing adapted to receive a drive shaft; and an impeller located within the impeller housing and adapted for connection to the drive shaft for rotation by the drive shaft about an axis;

wherein the seal arrangement includes an annular seal located axially between the impeller housing and the impeller to provide a substantially fluid tight seal between the impeller housing and the impeller.

2. A seal arrangement according to claim 1, wherein the annular seal includes two opposed substantially flat faces and a circumferential edge face.

3. A seal arrangement according to claim 2, wherein when the impeller assembly is assembled, one flat face of the seal contacts an interior face of the impeller housing and the opposite flat face of the seal faces a first surface of the impeller.

4. A seal arrangement according to any preceding claim, wherein the impeller includes lower and upper cover plates, the lower and upper cover plates being operably connected to form the impeller.

5. A seal arrangement according to claim 4, further including vanes defining fluid flow paths located intermediate the upper and lower cover plates.

6. A seal arrangement according to claim 5, wherein the vanes are formed integrally with the lower cover plate.

7. A seal arrangement according to claim 5 or 6 wherein the lower cover plate includes an integral central upstanding boss through which the drive shaft passes.

8. A seal arrangement according to claim 7, wherein the boss is keyed onto the drive shaft.

9. A seal arrangement according to any one of claims 4 to 8, wherein the surface of the upper cover plate facing away from the lower cover plate includes a raised annular lip, such that when the annular seal is placed over the central boss, one flat face of the seal sits against the raised lip of the impeller.

* * * * *

UNITED STATES PATENT AND TRADEMARK OFFICE

CERTIFICATE OF CORRECTION

PATENT NO. : 6,837,677 B2
APPLICATION NO. : 10/275166
DATED : January 4, 2005
INVENTOR(S) : David Da-Wei Zhang It is certified that error appears in the above-identified patent and that said Letters Patent is hereby corrected as shown below:

IN THE CLAIMS:

Col. 4, lines 23-61

Please replace the claims with the following:

--1. A seal arrangement for an impeller assembly, the impeller assembly including:

an impeller housing adapted to receive a drive shaft; and an impeller located within the impeller housing and adapted for connection to the drive shaft for rotation by the drive shaft about an axis;

wherein the seal arrangement includes an annular seal located axially between the impeller housing and the impeller, the annular seal being a floating seal moveable in the axial direction in response to an applied pressure differential, to provide a substantially fluid tight seal between the impeller housing and the impeller; and wherein the annular seal includes first and second opposed substantially flat surfaces and a circumferential edge face, and a surface of one of the annular seal and the impeller includes a raised annular lip, the annular lip being located intermediate the impeller and the annular seal.

2. A seal arrangement according to claim 1, wherein when the impeller assembly is assembled, the first surface of the seal contacts an interior face of the impeller housing and the opposite second surface of the seal faces a first surface of the impeller.

CERTIFICATE OF CORRECTION

PATENT NO. : 6,837,677 B2
APPLICATION NO. : 10/275166
DATED : January 4, 2005
INVENTOR(S) : David Da-Wei Zhang It is certified that error appears in the above-identified patent and that said Letters Patent is hereby corrected as shown below:

3. A seal arrangement according to claim 1 or 2, wherein the impeller includes lower and upper cover plates, the lower and upper cover plates being operably connected to form the impeller.

4. A seal arrangement according to claim 3, wherein the raised annular lip is formed on the surface of the upper cover plate facing away from the lower cover plate, such that the second surface of the seal sits against the raised lip of the impeller.

5. A seal arrangement according to claim 3, wherein the raised annular lip is formed on the second surface of the seal facing the impeller, such that the second surface of the seal including the raised annular lip sits against the upper cover plate of the impeller.

6. A seal arrangement according to any one of claims 3 to 5, further including vanes defining fluid flow paths located intermediate the upper and lower cover plates.

7. A seal arrangement according to claim 6, wherein the vanes are formed integrally with the lower cover plate.

8. A seal arrangement according to any one of claims 3 to 7, wherein the lower cover plate includes an integral central upstanding boss through which the drive shaft passes.

UNITED STATES PATENT AND TRADEMARK OFFICE

CERTIFICATE OF CORRECTION

PATENT NO. : 6,837,677 B2
APPLICATION NO. : 10/275166
DATED : January 4, 2005
INVENTOR(S) : David Da-Wei Zhang It is certified that error appears in the above-identified patent and that said Letters Patent is hereby corrected as shown below:

9. A seal arrangement according to claim 8, wherein the boss is keyed onto the drive shaft.--

Signed and Sealed this

Sixth Day of March, 2007

JON W. DUDAS
*Director of the United States Patent and Trademark Office*